United States Patent [19]

Bø

[11] Patent Number: 4,643,387

[45] Date of Patent: Feb. 17, 1987

[54] FORMWORK SYSTEM

[76] Inventor: Helge Bø, Bøvegen, N-5200 Os, Norway

[21] Appl. No.: 630,070

[22] Filed: Jul. 12, 1984

[51] Int. Cl.[4] ..... E04G 11/14; E04G 9/02

[52] U.S. Cl. ..... 249/193; 52/582; 249/18; 249/47; 249/197

[58] Field of Search ..... 249/47, 189, 193, 191, 249/192, 196, 44, 45, 18, 194, 197; 52/479, 480, 481, 582, 506

[56] References Cited

U.S. PATENT DOCUMENTS

| | | | |
|---|---|---|---|
| 830,893 | 9/1906 | Engelhardt | 249/47 |
| 1,299,200 | 4/1919 | McKay | 249/196 |
| 2,162,869 | 6/1939 | Symons | 249/193 |
| 2,522,360 | 9/1950 | Hamilton | 249/191 |
| 2,763,911 | 9/1956 | Rumble | 249/189 |
| 2,939,198 | 6/1960 | Nicholls | 249/47 |
| 3,363,371 | 1/1968 | Villalobos | 52/295 |

FOREIGN PATENT DOCUMENTS

| | | | |
|---|---|---|---|
| 138551 | 9/1978 | Denmark | 249/193 |
| 1559011 | 9/1969 | Fed. Rep. of Germany | 249/47 |
| 2305093 | 12/1973 | Fed. Rep. of Germany | 249/191 |
| 84/02943 | 8/1984 | PCT Int'l Appl. | 249/193 |
| 188191 | 3/1964 | Sweden | 249/193 |
| 363870 | 6/1973 | Sweden | 249/192 |
| 277910 | 9/1951 | Switzerland | 249/193 |

*Primary Examiner*—Jay H. Woo
*Assistant Examiner*—James C. Housel
*Attorney, Agent, or Firm*—Kenyon & Kenyon

[57] ABSTRACT

A formwork system (10) comprising frame elements (11), posts (12) for arrangement between the frame elements if necessary locking means (21), together with formwork sides (13). The frame elements are designed with longitudinal grooves (15) and/or keys at least in the sides which face towards the posts (12) for engagement with corresponding keys or slots in the post. The front side of the formwork side (13) after arrangement in the frame element is flush with the front side of the post, either in that the corners on the front side of the post, parallel to the key (18) or the groove, are designed with a longitudinal notch having a depth which is equal to the thickness of the formwork side or in that there is arranged on the inside of the frame element a longitudinal flange (16) at a distance from the front edge of the element equal to the thickness of the formwork side (13). On formworking of a pavement the key (18) and the groove (15) respectively have an angled cross-sectional form.

5 Claims, 3 Drawing Figures

FORMWORK SYSTEM

The present invention relates to a formwork system and, particularly to a formwork system for concrete construction.

In smaller formwork operations it is still customary to nail formwork sides on supports, whereby ends of the sides form abutments against each other back-to-back. Thereafter the formwork is levelled in the longitudinal direction with longitudinal beams, usually 5 cm×10 cm. This is a cumbersome process. It is time-demanding, and the wear on the formwork sides is great. In larger operations there are used larger formwork sides arranged on a reinforcing lattice work. Such elements are heavy and expensive, and are therefore limited in application to larger operations. There is also a problem with double boarding in that holes have to be bored in the formwork sides for locating spacing pieces.

On considering how large a portion of the expenses of a concrete operation is due to boarding there is still a need for improvements in the area.

The object of the present invention is to produce a formwork system which contributes to reducing the afore-mentioned problems.

The formwork system according to the invention is characterised in that the frame elements are designed with longitudinal grooves and/or keys at least in the sides which face towards the posts for engagement with corresponding keys or slots in the post, and in that the front side of the formwork side after arrangement in the frame element is flush with the front side of the post.

Preferably the post is designed with the key, while the frame element is thus designed with the corresponding groove.

One side of the groove (when it concerns a wall) constitutes a portion of the wall which bounds the concrete, so that the outside of the formwork side is thus flush with one side of the post.

For locating the formwork side, the side of the frame element facing towards the post is designed with a flange which extends parallel to the formwork side and which is arranged drawn in as much as the thickness of the side, or also there is designed in the post, parallel to the key or the groove, a longitudinal notch of right angled section which the formwork side rests against and which has such a breadth that the outer side of the side will be flush with the side of the post in question. The frame element must thereby be correspondingly narrower. The first-mentioned solution is preferred, owing to the fact that it is simpler to hold the formwork side in place when its dimensions are adapted to the dimensions of the frame element, so that it can be located with a force fit in the element.

In addition to keys or grooves in the faces of the frame element facing towards the posts this can also be designed with keys or grooves in the remaining two outer faces, thus up and down. These grooves and keys are intended to form an engagement with corresponding keys and grooves respectively of beams which are arranged respectively below and on top of the formwork. By beginning with a beam which is designed with keys, and which is put in position on a base in a desired direction, one has a good starting point for the formwork operation, and one can save later levelling work.

The formwork system according to the invention can be used both for boarding of walls and for boarding of roofs and pavements. In the last-mentioned instances it is preferred to use grooves and keys which have an angled cross-sectional form in order to obtain a locking of post to frame elements. It can also be used for boarding of round walls in that the post gives a trapezoidal crosssection, where the two sides which face towards the posts are equally long, while the two remaining sides have different lengths.

The invention will be further explained in the following description having regard to the accompanying drawings, where:

Figure 1:
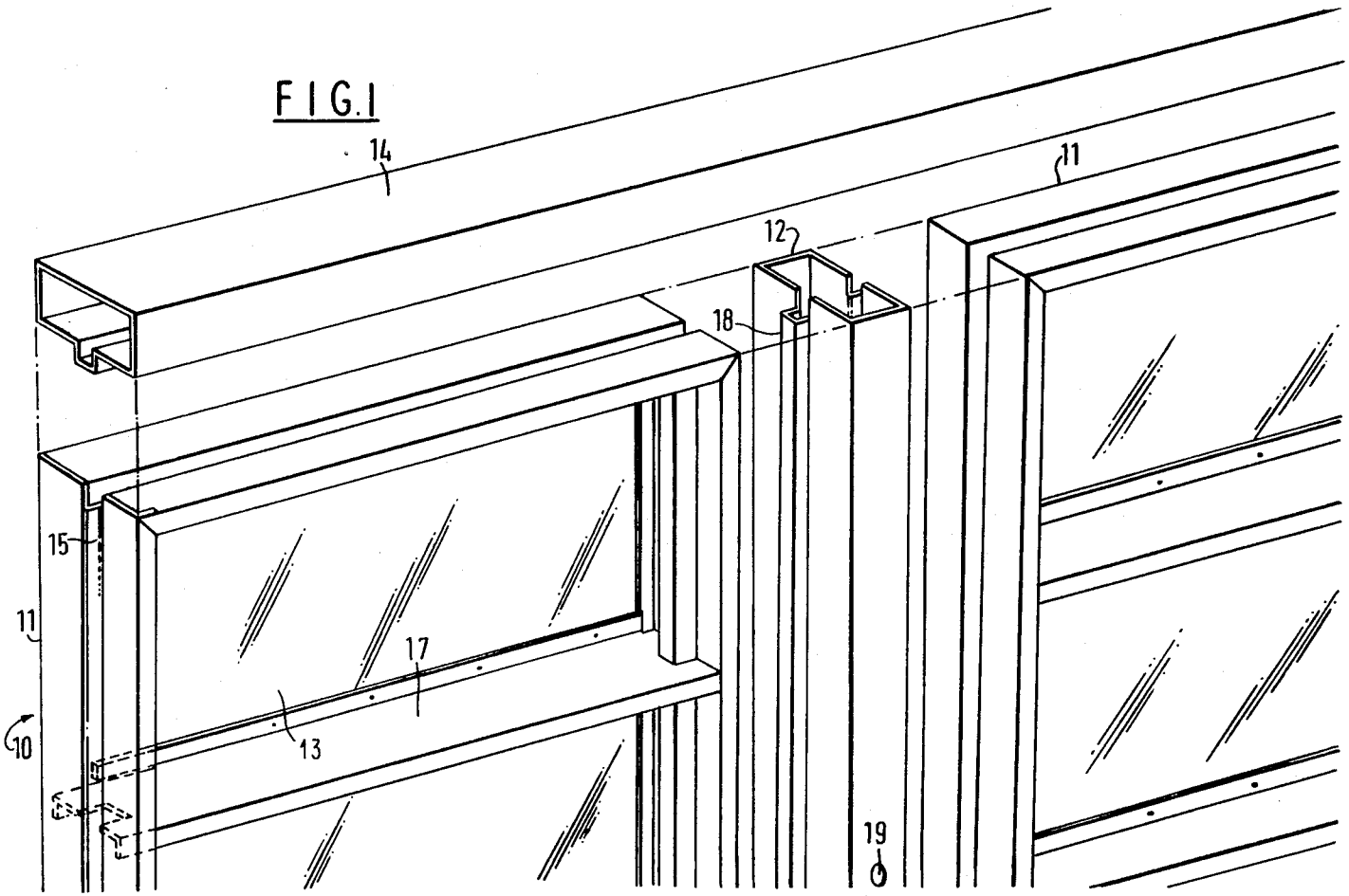
FIG. 1 shows a part of an expanded perspective view of an embodiment of the formwork system according to the invention.
Figure 2:
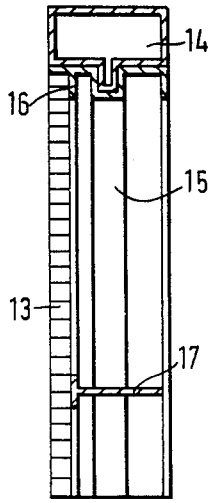
FIG. 2 shows a vertical section through the formwork system.

Referring to FIG. 1, the formwork system 10 which is used for boarding of a wall comprises a frame element 11, vertical posts 12, formwork sides or panel 13, an upper substantially horizontal beam 14, together with an equivalent beam (not shown) on the lower side.

Figure 3:
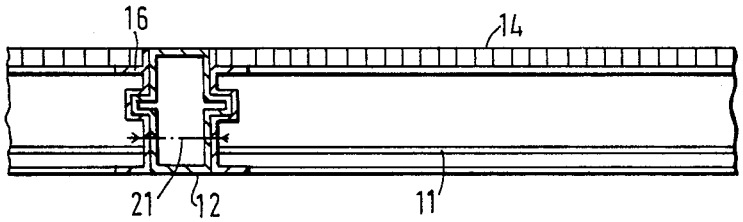
FIG. 3 shows a horizontal section through the formwork system.

The outer sides of the frame element 11 are provided with a peripheral groove 15, that is, the groove 15 is designed for all sides of the element. Parallel to one wall of this groove there is arranged a flange 16 on the inner side of the faces which face towards the posts 12. The distance of the flange 16 from the edge of the element 11 corresponds to the thickness of the formwork side or panels 13, so that when the formwork side is arranged in the frame element 11, it rests on the flange 16, while its outer side is flush with the edge of the frame element as shown in FIG. 3. In the illustrated embodiment the frame element is also provided with cross beams or struts 17, which act bracingly and which therefore are used especially when the frame elements have larger dimensions.

The post 12 is designed on each of the two sides which face towards the frame elements 11 with a longitudinal key 18. These keys fit in the grooves 15 in the frame elements 11. The keys are somewhat shorter than the post itself, in that they are cut off at the ends. There will thereby be formed grooves in the ends of the post, either in that this is hollow, or in that in addition to the keys 18 being shorter than the post itself there is cut out a groove in the end faces of the post. The grooves in the ends of the post are equivalent to the grooves in the frame elements 11, and correspond to a key on a face of the beam 14. The post 12 is also provided with holes 19. The object of these holes is to guide spacing pieces through them for use in double boarding. Thereby it is not necessary in such cases to bore through the formwork side itself.

The mode of operation in using the formwork system according to the invention in the casting of a wall is as follows: On a base there is arranged a beam 14 with the desired direction and of a desired length with the key upwards. On the beam 14 there is arranged a frame element 11 with the groove 15 in engagement with the key on the beam 14. Thereafter there is arranged a post 12 with the groove in the end face in engagement with the key on the beam and with the key 18 on the one side face in engagement with the groove 15 in the frame element 11. Thereafter there is arranged another frame element 11 on the opposite side of the post 12, with its groove in engagement with the key 18 on the post 12. In each frame element 11 there is arranged a formwork side 13 with a force fit and resting against the flange 16.

The post 12 and a frame element 11 on each side are connected to each other with the help of locking means, usually a wedge lock 21 (FIG. 3). The locking means also cause the formwork side to remain sitting better in position.

If is is desirable to have a higher boarding than the height of a formwork side or a frame element, one can arrange a beam 14, which has keys both on the under side and on the top side up on the erected boarding, and thereafter begin "anew" with the mounting of frame elements and posts. It is also possible to use posts which are equivalent to the height of several frame elements and continue with several frame elements directly on top of each other. The subsequent frame elements must thereby have keys on the under face for engagement with the groove in the upper face on the frame element below.

According to the invention there is produced a simple and practical formwork system where the formwork sides, posts and edges of the frame element together form the surface which faces towards the concrete. The individual components are easily handleable and make possible the erection of formwork without it being necessary to use cranes and without it being necessary for nailing, at any rate not in an especially extensive degree. The invention makes possible a significant saving of time relative to conventional formwork in smaller operations.

I claim:

1. A formwork system comprising a plurality of frame elements having horizontal and vertical elongated members;

a vertical elongated post adjacent a vertical member of at least one of said frame elements, with a transverse groove in an end face of said post;

a longitudinal key on either one of said vertical member of said at least one frame element or said post;

a longitudinal groove in the other of said vertical member of said at least one frame element or said post, said longitudinal groove receiving said key;

a formwork panel disposed in said frame element with a front side flush with a front side of said post; and a beam having a longitudinal key disposed in said transverse groove of said post and said longitudinal groove in a horizontal member of said frame element.

2. A formwork system as set forth in claim 1 wherein said frame element includes a flange spaced inwardly of and against said panel.

3. A formwork system as set forth in claim 1 wherein said post has at least one horizontal hole for guiding of a spacing piece therethrough.

4. A formwork system as set forth in claim 1 wherein each of said key and said grooves have a right angled cross-sectional form.

5. A formwork system comprising a vertical elongated post having a groove in at least one end face and a pair of longitudinal keys, said keys being disposed on opposite sides of said post;

a pair of frame elements, each frame element being disposed on a respective side of said post and having a peripheral groove, a vertical portion of said peripheral groove for receiving a respective key of said post;

a horizontal beam having a longitudinal key for reception in a horizontal portion of said peripheral groove of each frame element and said groove of said post; and a pair of panels, each said panel being disposed in a respective frame element to form a surface for casting of concrete.

* * * * *